US006186822B1

(12) United States Patent
Yang

(10) Patent No.: US 6,186,822 B1
(45) **Date of Patent: *Feb. 13, 2001**

(54) LAMP SOCKET WITH A PULL STRING SWITCH

(75) Inventor: Wen Ho Yang, Taipei Hsien (TW)

(73) Assignee: Sun Lite Sockets Industry, Inc., Taoyuan Hisen (TW)

( * ) Notice: Under 35 U.S.C. 154(b), the term of this patent shall be extended for 0 days.

This patent is subject to a terminal disclaimer.

(21) Appl. No.: 09/244,045

(22) Filed: Feb. 4, 1999

(51) Int. Cl.[7] ..... H01R 13/58

(52) U.S. Cl. ..... 439/457; 439/438; 439/420

(58) Field of Search ..... 439/456, 457, 439/660; 313/493, 318.04, 490; 362/289

(56) References Cited

U.S. PATENT DOCUMENTS 1,057,320 * 3/1913 Barr ..... 439/457

* cited by examiner

*Primary Examiner*—Paula Bradley
*Assistant Examiner*—Alexander Gilman
(74) *Attorney, Agent, or Firm*—Bacon & Thomas, PLLC

(57) ABSTRACT

A lamp socket with a pull string switch includes a socket body, a screw base, and a pull string switch combined in the socket body. The improved feature is two power lead protectors formed on an upper end surface of the socket body for separating two power leads so that the power lead protectors may hamper accidental force of pulline the power leads from directly transmitted to connect points of the power leads. Thus the connect points may not disconnected from the terminals or become badly connected with the terminals, keeping good quality of the power leads in transmitting electricity and safety of using electricity.

1 Claim, 4 Drawing Sheets

LAMP SOCKET WITH A PULL STRING SWITCH

BACKGROUND OF THE INVENTION

This invention relates to a lamp socket with a pull string switch, particularly to one preventing power leads from loosening off, or becoming badly connected with terminals, so as to keep good quality of the power leads in transmitting power and safety of using electricity.

A known traditional lamp socket with a pull string switch is shown in FIG. 1, includes a socket body 1 and a screw base 2 as main components.

The socket body 1 is made of an insulating material, having two terminals 11, 12 at two sides for connecting two power leads of a single phase, and a Pull string switch 13 is combined in the socket body 1 for turning on and off a lamp screwed in the socket body 1.

The screw base 2 is made of a conductive material, and having screw grooves for a lamp to screw with.

Though the known traditional lamp socket with a pull string switch has a function to turn on and off a a lamp, the power leads fixed with the terminals 11 and 12 may fall off the terminals 11 and 12 in case of the screws loosened or the power leads accidentally pulled excessively by an improper force. Even if the power leads do not fall off the terminals 11 and 12 but only contact not well with the terminals, there might arise uneven load current, which might cause large load current to start a fire.

SUMMARY OF THE INVENTION

The present invention has been devised to offer a lamp socket with a pull string switch, which can prevent power leads from loosening off terminals or growing not well connected with the terminals, so as to keep stability of the power leads and safety of using electricity.

A main feature of the invention is two power lead protectors formed on a socket body for protecting the power leads to stop accidental force of Pulling them and preventing the accidental force from transmitted to the terminals to keep the both well connected with each other.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
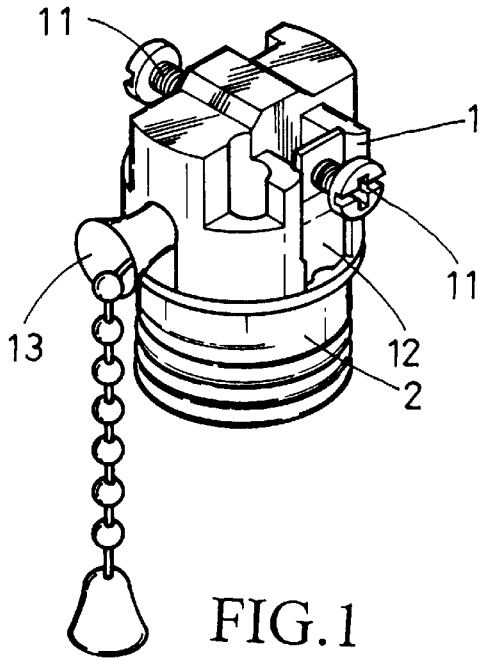
FIG. 1 is a perspective view of a known traditional lamp socket with a pull string switch.
Figure 2:
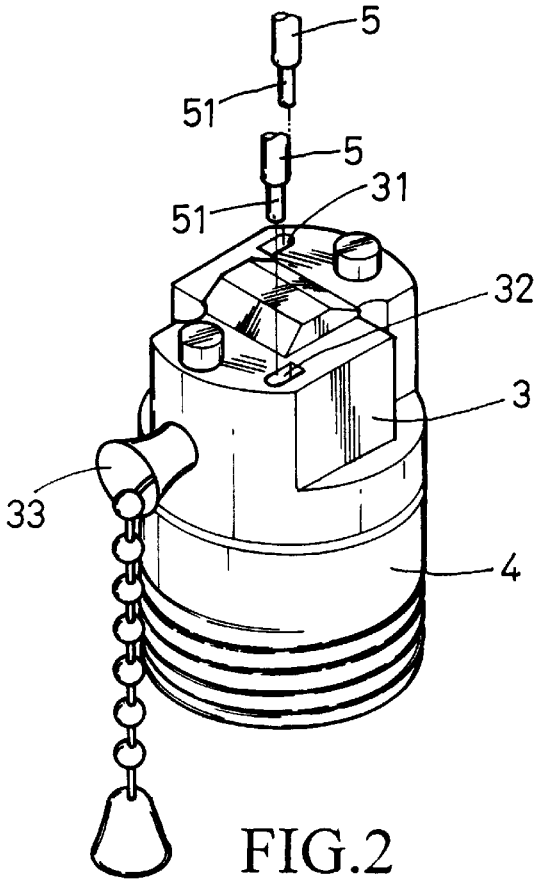
FIG. 2 is a perspective view of another known traditional lamp socket with a pull string switch.
Figure 3:
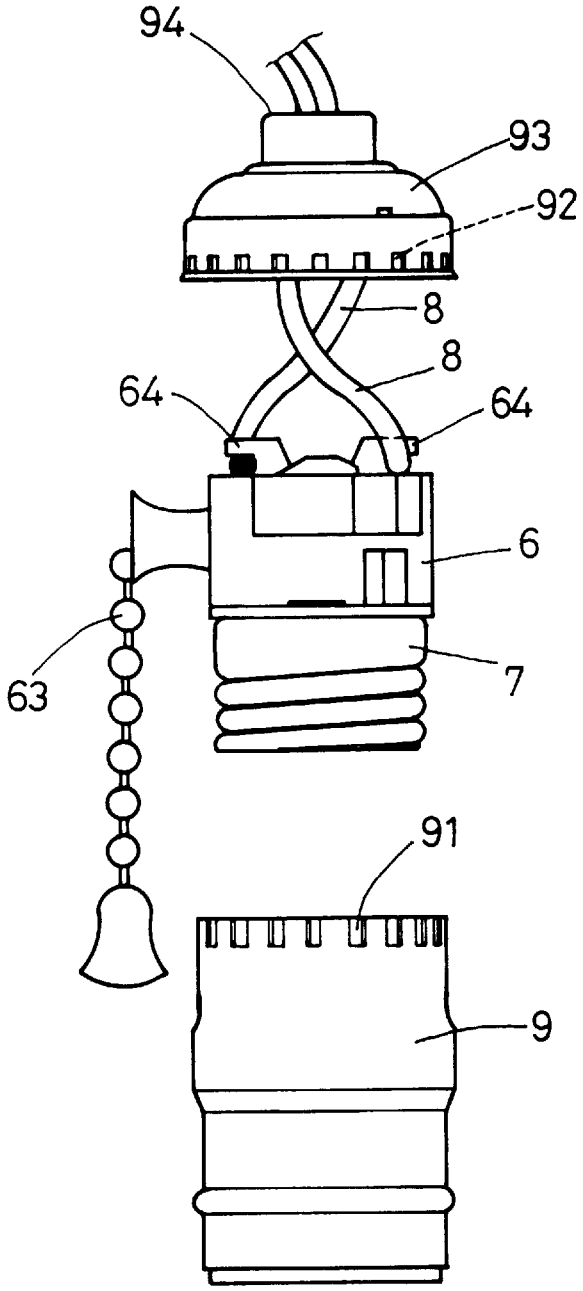
FIG. 3 is an exploded perspective view of a lamp socket with a pull string switch in the present invention.
Figure 4:
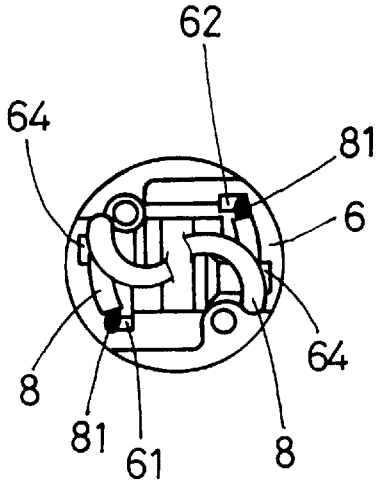
FIG. 4 is an upper view of the lamp socket with a pull string switch in the present invention.
Figure 6:
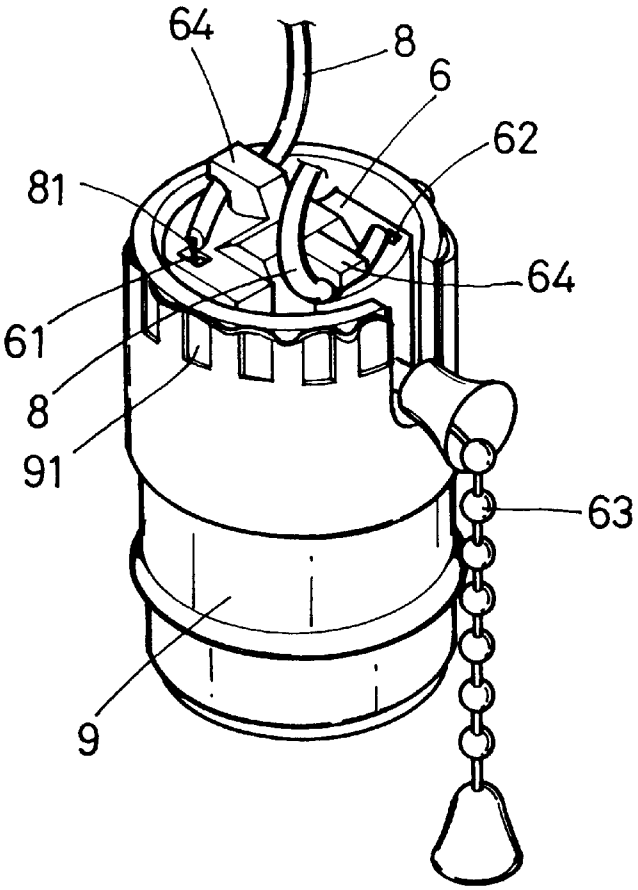
FIG. 6 is a perspective view of the lamp socket with a pull string switch in the present invention, with a cap removed; and, FIG. 7 is a perspective view of the lamp socket with a pull string switch in the present invention, showing the power leads fixed with the terminals by means of screws.
Figure 7:
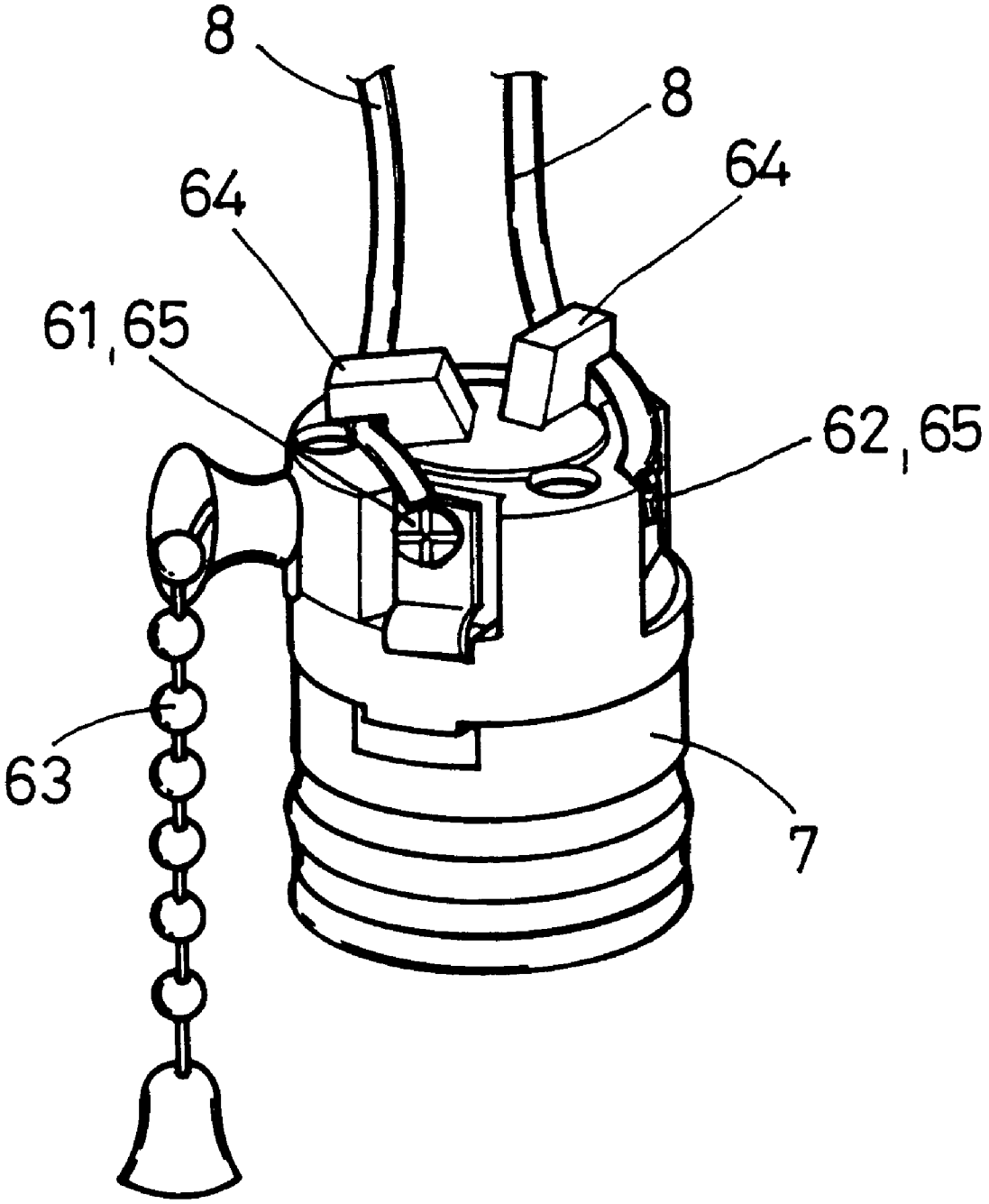

A preferred embodiment of a lamp socket with a pull string switch in the present invention, as shown in FIG. 3 and 4, includes a socket body 6, a screw base 7 and a pull string switch 63, as the same fundamental structure as the known traditional one. Further, two terminals 61 and 62 are provided, having holes for the two ends of power leads 8 to be inserted firmly therein as shown in FIG. 6, or having screws 65 for fixing the two ends of the power leads 8 tightly against the terminals 61 and 62 as shown in FIG. 7. Those structure are not the characteristics of the present invention.

The main characteristics of the invention is two power lead protectors 64 formed on an upper end surface of the socket body 6, as shown in FIG. 6, for separating the power leads 8 from each other, and hampering accidental force added to the power leads 8 from transmitted directly to the connect points 81 of the power leads 8. Thus t;he lead protectors 64 can prevent the connect points 81 of the power leads 8 from disconnected from the terminals 61 and 62 or becoming badly connected with the terminals 61 and 62, so as to secure good quality of the power leads in transmitting power and safety of using electricity.

Between each of the power lead protectors 64 and the upper surface of the socket body 6 is formed an aperture just large enough for each power lead 8 to extend through so that the two power leads 8 may be separated from each other.

Further, the two power lead protectors 64 can be positioned respectively at the same side of the two terminals 61 and 62 so as to facilitate the power leads 8 be connected with the terminals 61 and 62.

At least one power lead protectors may be provided with the socket body 6, depending on the number of power leads practically used.

Figure 5:
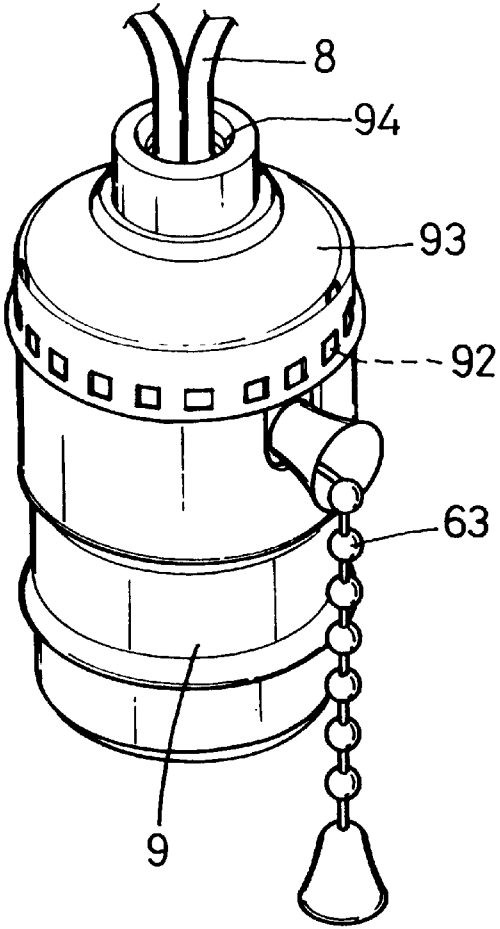
FIG. 5 is a perspective view of the lamp socket with a pull string switch in the present invention, showing it connected with two power leads.

An outer shell 9 made of an insulating material is provided to house the screw base 7 for preventing persons from touching the screw base 7 and get shocked by electricity, as the screw base 7 is made of a conductive material. FIGS. 3 and 6 shows the outer shell 9 and a cap 93 closing on the outer shell 9 and hiding the upper end of the socket body 6. For combining the outer shell and the cap 93, the outer shell 9 has a plurality of engage recesses 91 formed in an upper edge, and the cap 93 has a plurality of engage projections 92 formed in a lower edge to engage the engage recesses 91, as shown in FIG. 5. The cap 93 further has a center hole 94 for the power leads 8 to extend out of the socket body 6, limiting the direction of pulling force of the power leads 8. Then the socket body 6 can be protected from dirt by means of the cap 93, and the power lead protectors 64 are also protected so that accidental force of pulling the power leads 8 may not be directly transmitted to the connect points 81, which then never fall off the terminals 61 and 62, maintaining safety of using electricity.

It must be stressed that the terminals 61 and 62 may have the structure either of inserting holes as shown in FIG. 6 or of screw fixing as shown in FIG. 7, and as long as the lamp socket with a pull string switch has a power lead protector 64 in the socket body, it is covered in the scope of the claim of the present invention.

The present invention has the following advantages, compared with the known traditional lamp socket with a pull string switch.

1. The power leads may not loosen off the socket body, even if an external force should be added to pull them, having safety in using electricity.

2. It can prevent persons from accidentally touching and shocked by electricity, safe in using electricity.

3. It has a cap to prevent not only dirt but also flying insects from flying in the socket body, securing good Function or electric transmitting.

While the preferred embodiment of the invention has been described above, it will be recognized and understood that various modifications may be made therein and the appended claims are intended to cover all such modifications which may fall within the spirit and scope of the invention.

I claim:

1. A lamp socket with a pull string switch including:

a stand made of an insulation material, provided with two terminal jacks to receive and hold in position power lead-in wires;

a socket made of a conductive material fixed to the stand; a screw base to receive and hold a bulb in position; a pull string switch to control turning on or off the light and at least a one lead-in wire support; characterized in that the wire support is molded integrally with the stand; said wire support includes a rectangular in plane cantilever portion having a top surface substantially parallel to the top surface of the stand and an inner surface substantially curvilinear; said configuration simplifies molding and an insertion of the wire in the position.

* * * * *